US011087967B1

(12) United States Patent
Nikolaev et al.

(10) Patent No.: US 11,087,967 B1
(45) Date of Patent: Aug. 10, 2021

(54) OPEN DYNAMICALLY HARMONIZED ION TRAP FOR ION CYCLOTRON RESONANCE MASS SPECTROMETER

(71) Applicant: SKOLKOVO INSTITUTE OF SCIENCE AND TECHNOLOGY, der. Skolkovo (RU)

(72) Inventors: Evgeniy Nikolaevich Nikolaev, Moscow (RU); Anton Valerevich Lioznov, Sankt-Peterburg (RU); Oleg Nikolaevich Kharybin, p. Vniissok (RU); Gleb Nikolaevich Vladimirov, Khimki (RU)

(73) Assignee: SKOLKOVO INSTITUTE OF SCIENCE AND TECHNOLOGY, Der. Skolkovo (RU)

( * ) Notice: Subject to any disclaimer, the term of this patent is extended or adjusted under 35 U.S.C. 154(b) by 0 days.

(21) Appl. No.: 17/063,749

(22) Filed: Oct. 6, 2020

(30) Foreign Application Priority Data

Apr. 10, 2020 (RU) ..... RU2020113304

(51) Int. Cl.
*H01J 49/36* (2006.01)
*H01J 49/42* (2006.01)

(52) U.S. Cl.
CPC ..... *H01J 49/36* (2013.01); *H01J 49/424* (2013.01)

(58) Field of Classification Search
CPC ..... H01J 49/36; H01J 49/424
USPC ..... 250/281, 282, 283, 290, 291
See application file for complete search history.

(56) References Cited

U.S. PATENT DOCUMENTS

2010/0301204 A1* 12/2010 Koster ..... H01J 49/425 250/283
2012/0193529 A1* 8/2012 Nikolaev ..... H01J 49/38 250/282
2015/0364304 A1* 12/2015 Nikolaev ..... H01J 49/425 250/282

* cited by examiner

*Primary Examiner* — Nicole M Ippolito
(74) *Attorney, Agent, or Firm* — Nixon & Vanderhye P.C.

(57) ABSTRACT

The invention discloses design of the open-type dynamically harmonized trap directly incorporated into the body of vacuum chamber of Fourier transform ion cyclotron resonance mass analyzer. The proposed trap provides ultra-high resolution of the mass spectrometer as well as improves performance of the instrument, increases pumping rate (accelerates evacuation), eliminates necessity in vacuum feed-through, and increases maximum trap resolution limit at a fixed magnetic field.

4 Claims, 7 Drawing Sheets

OPEN DYNAMICALLY HARMONIZED ION TRAP FOR ION CYCLOTRON RESONANCE MASS SPECTROMETER

CROSS-REFERENCE TO RELATED APPLICATIONS

The present application claims the benefit of Russian Patent Application RU 2020113304 filed on Apr. 10, 2020. The contents of the abovementioned applications are incorporated by reference herein.

FIELD OF THE INVENTION

The invention relates to the field of mass spectrometry, namely, it describes design of the open-type dynamically harmonized trap for the ion cyclotron resonance mass spectrometer. The proposed trap provides ultra-high resolution of the mass spectrometer while improving performance of the instrument. The invention can find applications in many areas of technology.

BACKGROUND

The mass analyzer of Fourier transform ion cyclotron resonance (FT/ICR) is a type of mass analyzer for determining mass-to-charge ratio based on cyclotron frequency of ion rotation in a fixed magnetic field. FT/ICR ensures the highest mass measurement accuracy and resolution among all mass spectrometric methods. FT/ICR is used to solve problems that require increased resolution such as analysis of complicated mixtures. To increase mass measurement resolution and accuracy at a given magnetic field, it is necessary to increase the length (duration) of the detected signal induced by ions rotating with cyclotron frequencies in the ion trap of the mass analyzer. For this, it is necessary that the cyclotron frequency for all ions with the same mass-to-charge ratio was the same, radius of cyclotron motion did not decay too quickly, and ion packet moved for a long time without diverging in phase. However, said conditions may be unreachable even in an ideal uniform magnetic field and in absence of ion-ion interaction and collisions with neutral molecules due to the fact that an electric field is required to confine ions, which leads to loss of synchronization of cyclotron motion. In conventional ion cyclotron resonance traps such as cubic, closed cylindrical or open-type cylindrical traps, ions with different amplitudes of longitudinal oscillations have slightly different measured frequencies (so-called effective cyclotron frequencies), which differ from the frequencies of cyclotron motion of ions in the magnetic field in absence of the electric field. In contrast, in special geometry traps (hyperboloidal traps with the electric field potential quadratically depending on coordinates), measured frequency, in general case without magnetron motion, is equal to difference between the cyclotron frequency (frequency of ion motion in a magnetic field in absence of an electric field) and a drift frequency (frequency of motion in the direction perpendicular to both magnetic and electric fields). In such traps, signal length can be made as large as needed, if vacuum is deep enough. Therefore, the factor that limits signal length in conventional traps is the distinction of the electric potential holding ions in the axial direction from that in the hyperboloidal traps. In said conventional traps, measured frequency is higher for ions with a larger amplitude of longitudinal oscillations than that for ions with smaller amplitude, since in such traps said effective cyclotron frequency is increased by adding a drift frequency, which linearly depends on the component of electric field potential gradient perpendicular to the magnetic field, this gradient increasing with the axial coordinate (and, accordingly, amplitude of longitudinal oscillations in the cubic or cylindrical ICR traps). This phenomenon leads to ion packet misphasing in the case of different amplitudes of axial ion oscillations as well as disappearance of measured signal, which causes decrease in resolution of the ICR mass spectrometer. Signal duration also depends on magnetic field, since the frequency of drift motion is inversely proportional to the magnetic field. In addition, signal duration significantly increases with number of ions due to ion-ion interactions, but this effect decrease the resolution rather than increasing it despite the increase in the signal duration, because ions with close mass-to-charge ratios move with nearly identical frequencies and phases and cannot be resolved in an ICR mass spectrum.

Attempts had been made to create such a confining electric field that as weakly as possible disturbs the equiphase condition of an ion packet (so-called trap harmonization) due to a special configuration of ion trap electrodes (G. Gabrielse, L. Haarsma, S. L. Rolston. Int. J. Mass Spectrom. Ion Processes 1989, 88, 319; A. V. Tolmachev, et al., J. Am. Soc. Mass Spectrom., 2008, 19, 586; A. M. Brustkern, et al., J. Am. Soc. Mass Spectrom. 2008, 19, 1281). In such traps, an electric field as close as possible to a hyperbolic one is formed, since such field theoretically does not cause ion misphasing at all. However, such field can be formed only in center of the trap, while in vicinity of electrodes the field substantially deviates from the hyperbolic one. An alternative approach, which was first proposed in patent application WO2011045144 and article by I. A. Boldin and E. N. Nikolaev, Rapid Commun. Mass Spectrom. 2011, Jan. 15, 25 (1): 122-126, was based on generation of a confining electric field that initially mismatches to a truly hyperbolic one, but can become hyperbolic after averaging over the cyclotron period. Theoretically (since it can be assumed that axial oscillation frequency is much less than the cyclotron frequency), the electric field configuration proposed in application WO2011045144 must cause no ion packet misphasing in course of orbiting of constituent ions with any cyclotron radii and axial oscillation amplitudes, which must provide an ultra-high resolution. Based on this approach, Brucker company had designed and commercialized a dynamically harmonized ion trap (ParaCell) and mass spectrometers with such trap (solarix XR and scimaX). However, implemented electrodes configuration in the ParaCell ion trap turned out to be non-optimal when trying to further raise the resolution by increasing magnetic field, and the authors made an attempt to modify it. Thus, the market still demands ultra-high resolution mass spectrometers, and this invention is intended to improve performance of existing traps.

SUMMARY OF THE INVENTION

The aim of this invention is to provide an open-type dynamically harmonized ion trap for an ion cyclotron resonance mass spectrometer.

This aim is achieved by modifying configuration of electrodes in dynamically harmonized ion trap of an ion trap of an ion cyclotron resonance (ICR) mass analyzer used for accumulating and detecting ions, having form of an open cylinder without end walls, a conducting surface of the open cylinder being divided by slots into two central electrode systems and two side electrodes, wherein the trap has a plane of symmetry perpendicular to an axis of the open cylinder and passing through a center of the trap; the first central electrode system consists of an even number of curvilinear overlapping biangles with excluded overlapping regions, wherein only adjacent biangles of this system are overlapped, whereas the second central electrode system consists of the overlapping regions; width of each biangle of both central systems is a quadratic function of a coordinate directed along the axis of the open cylinder to the center of the trap, and originated from vertexes of the biangle, with maximum electrode width corresponding to the center of the trap; a constant potential $V_0$ is applied to the first central electrode system through resistors, whereas the second central electrode system is grounded in relation to direct current (DC); side electrodes of the trap are located on both sides of the first central electrode system, said side electrodes having form of insulated cylinders being a part of the open cylinder having a zigzag joint boundary with the first central electrode system formed by slots in the open cylinder, wherein outer side boundaries of the side electrodes are circles, which electrically isolate the side electrodes from a vacuum system, and a potential 2.2 $V_0$ is applied to the side electrodes; a field potential inside the trap generated by the two electrode systems is harmonic over an entire trap volume and quadratic along the axis of the open cylinder when averaged over a cyclotron orbit of ions.

In some aspects of the invention, this electrode system is characterized in at least one of the following: a) the trap is integrated into a vacuum chamber of the ICR mass analyzer such that inner surfaces of the trap are in vacuum, while the outer surfaces are at atmospheric pressure; b) the trap is a part of a tube inserted into solenoid generating a magnetic field; c) all slots between the electrodes of the trap are filled with a vacuum-tight insulator, and potentials are applied to the electrodes from the outer surfaces. Thus, the design according to the invention is characterized in that the measuring cell is a constituent of the vacuum system rather than a component inserted into the vacuum system. In this case, all slots between the trap electrodes are filled with a vacuum-tight insulator. When an insulator is required for slots, a vacuum-tight insulator with a coefficient of expansion close to that of electrode material should be used. The material of the insulator must be non-magnetic like the material of the electrodes.

In some aspects of the invention, said electrode system is characterized in that in order to excite and detect the signal, radio-frequency alternating-current potentials are applied to some of said electrodes (from outer atmospheric side of electrode surfaces) of both first and second central electrode system via capacitors to excite cyclotron motions of ions in the trap, while signals induced by rotating ions are taken from the other electrodes of the second central electrode system, the electrodes optionally being combined into groups through capacitors of corresponding capacity.

The capacitors should be selected so that the alternating current resistance between the source and the electrode in the range of operating cyclotron frequencies was minimal. The capacitors are used to isolate trap electrodes from each other in relation to direct current. This feature allows to apply functionally necessary direct and/or alternating current voltage to electrodes.

In some aspects of the invention, said electrode system is characterized in that the second central electrode system comprises four, eight, twelve, or sixteen electrodes in the shape of a curvilinear biangle located on the surface of the open cylinder.

The object of the present invention is to improve performance of said instrument, accelerate trap pumping, make said vacuum deeper (due to absence of vacuum feed-through), and, as a result, heighten the maximum resolution limit of said trap at a fixed magnetic field.

DETAILED DESCRIPTION OF THE INVENTION

Figure 1A:
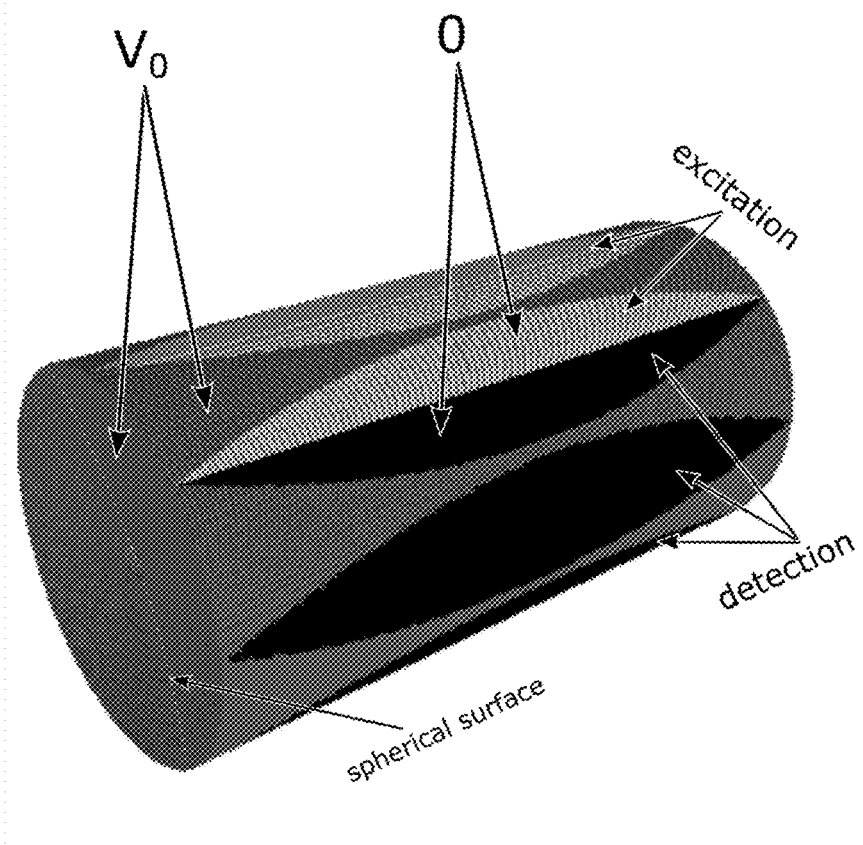
FIG. 1. Design of dynamically harmonized closed ICR trap. (A) An example of dynamically harmonized closed ICR trap with 8 segments per trap. Arrangement of detecting and exciting sections is shown, each comprising five electrodes. (B) A cross-section of the ICR trap.

For the better understanding of this invention, a list of some terms used in present disclosure of the invention is given below. The terms "comprises" and "comprising" in the disclosure of this invention are interpreted as "comprises, but not limited to". The said terms are not intended to be interpreted as "consists only of". Unless specified otherwise, technical and scientific terms in this application have standard meanings common in science and technical literature.

As it was mentioned above, to ensure long-term equiphase motion of ions in the ICR trap, it is necessary to generate a field with the hyperbolic geometry. Hyperbolic field is expressed as:

$$\Phi(r, z) = \frac{1}{2}\gamma(2z^2 - r^2), \tag{1}$$

where ϕ is electric potential, $r=\sqrt{x^2+y^2}$, γ is a coefficient proportional to the blocking potential, and the z direction is chosen parallel to direction of the magnetic field vector. For a field of this type, equations of motion can be solved exactly. In this configuration of electric field, variables can be separated, and motion of ion becomes consisting of three independent modes:

1) Oscillation along z-axis with the frequency $\omega_z$ $$\omega_Z = \sqrt{\frac{2q\gamma}{m}}; \tag{2}$$

2) Rotation in xy-plane (cyclotron motion) with the frequency $\omega_+$:

$$\omega_+ = \frac{\omega_c}{2} + \sqrt{\left(\frac{\omega_c}{2}\right)^2 - \frac{\omega_z^2}{2}}; \tag{3}$$

3) Rotation in xy-plane (magnetron motion) with the frequency $\omega_-$:

$$\omega_- = \frac{\omega_c}{2} - \sqrt{\left(\frac{\omega_c}{2}\right)^2 - \frac{\omega_z^2}{2}}; \tag{4}$$

where $\omega_c$=qB/m is the frequency of cyclotron motion in absence of electric field, q and m are the charge and mass of the particle, respectively, B is the magnetic field. It is seen from these equations that the measured frequency in this case is the same for all ions, regardless of initial coordinates and velocities.

An almost ideal hyperbolic field can be created using a three-dimensional hyperbolic trap, but this approach has a significant drawback, namely, the trap electrodes require a bulk of space and the region of high magnetic field uniformity is used ineffectively. Another approach consists in designing an ICR trap with a blocking field close to hyperbolic one (so called ICR trap harmonization).

Due to the fact that ions in an ion resonance mass spectrometer rotate in a strong magnetic field, the frequency of their cyclotron rotation is much higher than the frequency of axial oscillations and the drift frequency. Previously, instead of creating a true hyperbolic field, the authors created a field that would be harmonious after averaging over the cyclotron period (see WO2011045144). In theoretical calculations, averaging was carried out over a circular orbit instead of a real trajectory along a helix, since the cyclotron motion is much faster than all others. In such case, the cyclotron orbit can be described by the equations:

$$x = R_c \cos(\omega_+ t)$$

$$y = R_c \cos(\omega_+ t), \tag{5}$$

where $R_c$ is the cyclotron radius and origin is chosen in center of the trap. Let the potential be written in cylindrical coordinates as $\varphi(z,r,\alpha)$, then components of the force acting on the particle averaged over the cyclotron motion z and r can be expressed by the following equations:

$$\hat{F}_z = \frac{q}{m}\frac{1}{T}\int_0^T \frac{\partial\varphi}{\partial z}dt = \frac{q}{m}\frac{1}{2\pi}\int_0^{2\pi}\frac{\partial\varphi}{\partial z}d\alpha = \frac{q}{m}\frac{1}{2\pi}\frac{\partial}{\partial z}\int_0^{2\pi}\varphi d\alpha = \frac{q}{m}\frac{\partial\hat{\varphi}(z,r)}{\partial z}, \tag{6}$$

-continued $$\hat{F}_r = \frac{q}{m}\frac{1}{T}\int_0^T \frac{\partial\varphi}{\partial r}dt = \frac{q}{m}\frac{1}{2\pi}\int_0^{2\pi}\frac{\partial\varphi}{\partial r}d\alpha = \frac{q}{m}\frac{1}{2\pi}\frac{\partial}{\partial r}\int_0^{2\pi}\varphi d\alpha = \frac{q}{m}\frac{\partial\hat{\varphi}(z,r)}{\partial r}, \tag{7}$$

$$\text{where } T = 2\pi/\omega_+,\ \hat{\varphi}(z,r) = \frac{1}{2\pi}\int_0^{2\pi}\varphi(z,r,\alpha)d\alpha.$$

Here the Leibniz formula was applied. It can be seen from formulas (6, 7) that variables in the equations can be separated in the same way as in the case of a real hyperbolic potential, if the potential averaged over the cyclotron period was hyperbolic.

In order to find configuration of electrodes, which yields the potential averaged over the cyclotron motion in the form $\hat{\varphi}(z,r)$, it is necessary to take advantage of the fact that this potential satisfies the Laplace equation. This statement can be proved by again using the Leibniz formula:

$$0 = \frac{1}{2\pi}\int_0^{2\pi}(\Delta\varphi)d\alpha = \frac{1}{2\pi}\int_0^{2\pi}\left(\frac{1}{r}\frac{\partial\varphi}{\partial r} + \frac{\partial^2\varphi}{\partial r^2} + \frac{\partial^2\varphi}{\partial z^2} + \frac{1}{r^2}\frac{\partial^2\varphi}{\partial\alpha^2}\right)d\alpha == \frac{1}{r}\frac{\partial\hat{\varphi}}{\partial r} + \frac{\partial^2\hat{\varphi}}{\partial r^2} + \frac{\partial^2\hat{\varphi}}{\partial z^2} + \frac{1}{2\pi}\frac{1}{r^2}\int_0^{2\pi}\frac{\partial^2\varphi}{\partial\alpha^2}d\alpha = \frac{1}{r}\frac{\partial\hat{\varphi}}{\partial r} + \frac{\partial^2\hat{\varphi}}{\partial r^2} + \frac{\partial^2\hat{\varphi}}{\partial z^2} = \Delta\hat{\varphi}, \tag{8}$$

$$\text{because } \int_0^{2\pi}\frac{\partial^2\varphi}{\partial\alpha^2}d\alpha = 0.$$

Figure 1B:
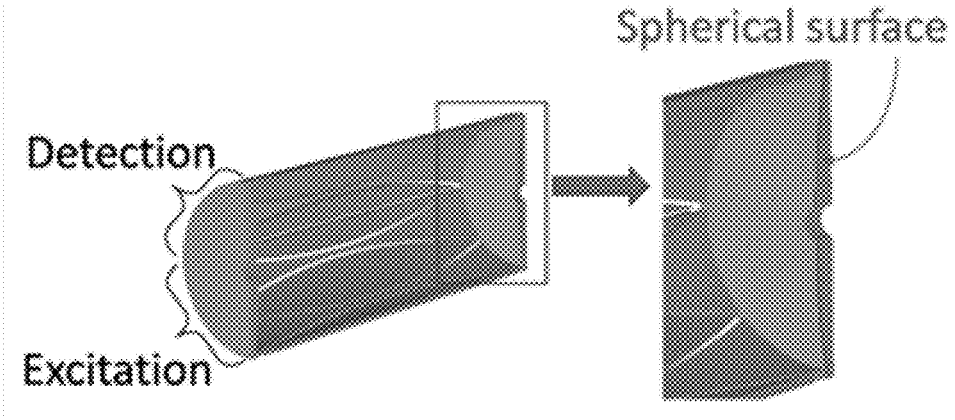

In the case of ICR trap, an averaged hyperbolic potential $\hat{\varphi}(z,r)$ can be created by cutting the cylindrical part into segments and adjusting shapes of these segments. Then the boundary conditions for the potential $\hat{\varphi}(z,r)$ are:

$$\hat{\varphi}(z,R) = A\cdot z^2 + B, \tag{9}$$

where R is radius of trap, A and B are arbitrary coefficients. This condition is satisfied if the surface of trap electrodes is cut as shown in FIG. 1. A blocking voltage is applied to the narrower, concave electrodes, while the wider, convex electrodes are grounded.

Cuts are parabolic and defined by the equation:

$$\alpha = \frac{2\pi}{N}n \pm \alpha_0\left(1 - \left(\frac{z}{a}\right)^2\right);\ n = 0, 1, \ldots, (N-1), \tag{10}$$

where N is number of electrodes of each type, $\alpha_0$ is an arbitrary coefficient, and a is the half-length of the trap. Then the boundary conditions can be expressed using the equation:

$$\hat{\varphi}(z,R) = V_0\left(1 - \frac{\alpha_0}{(\pi/N)}\left(1 - \left(\frac{z}{a}\right)^2\right)\right). \tag{11}$$

In order to obtain an averaged hyperbolic field in a trap of finite length, it is necessary that the boundary conditions at the end electrodes satisfied the Laplace equation as well. Then, according to equation (11), the averaged potential should have the following form:

$$\hat{\varphi}(z, R) = V_0\left(1 + \frac{\alpha_0}{2a^2(\pi/N)}(2(z^2 - a^2) - (r^2 - R^2))\right). \quad (12)$$

One possible version of the electrode configuration that satisfies the boundary conditions comprises hyperbolic electrodes at both ends of the trap under applied blocking potential $V_0$. According to equation (12), shape of these electrodes is determined by the equation:

$$2(z^2+a^2)-(r^2+R^2)=0. \quad (13)$$

There is no need to make cuts in end electrodes since the ICR trap has much weaker length limitations than diameter ones. Above theoretical considerations were put into base of elongated trap according to present invention with the shape shown in FIGS. 1 and 2. The trap electrodes are located on the cylinder surface. There are two types of electrodes: biangles (convex electrodes) and complementary electrodes located between biangles (concave electrodes).

In order to ensure excitation of the cyclotron motion of ions and detection of the signal induced by these ions, as it is done in conventional ICR traps, every second convex electrode (in the case of the eight-electrode trap shown in FIGS. 1 and 2) was cut into two equal parts along the cylinder axis. The difference between conventional ICR traps and the trap presented in FIGS. 1 and 2 consists in the fact that exciting and detecting electrodes in the conventional trap are integral parts of the cylinder, whereas in the new trap these electrodes consist of segments, and each detecting or exciting section (set of adjacent electrodes combined via capacitors in relation to radio frequency voltage) comprises five electrodes connected via a capacitor, a zero or constant blocking potential being individually applied to each section. Signal detection in this circuit is possible only using grounded (constant voltage) plates to reduce electrical noise induced by constant voltage sources in the signal.

Figure 2:
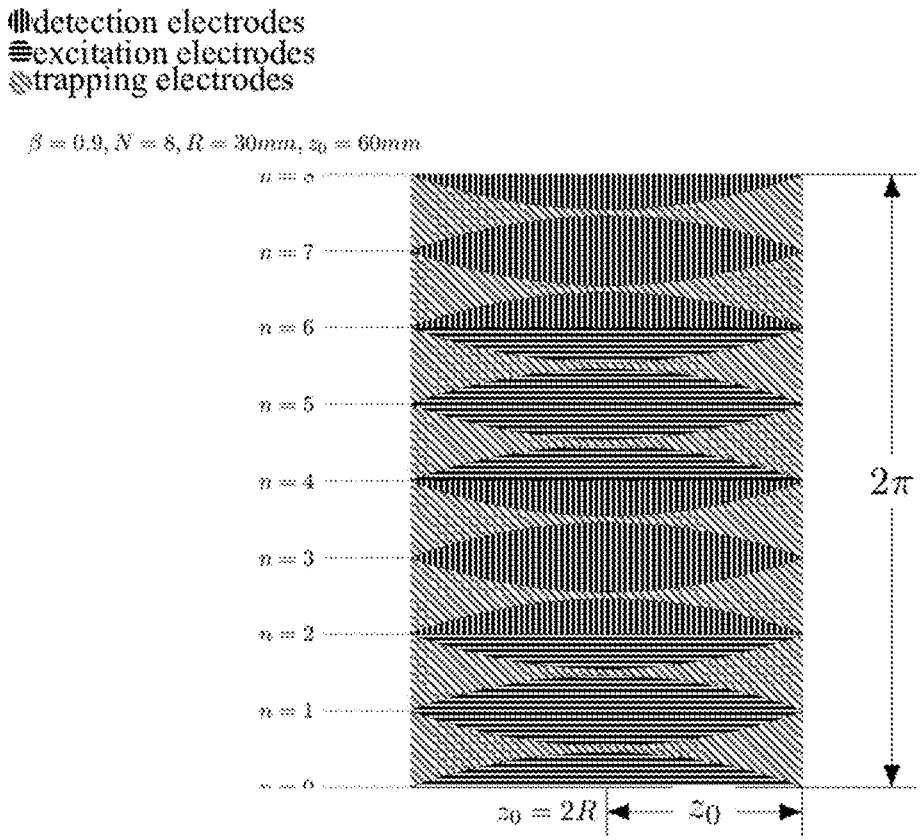
FIG. 2. A detailed segmentation diagram of an embodiment of a dynamically harmonized closed ICR trap presented as a projection of electrodes onto a plane by unrolling the cylindrical surface bearing the trap electrode system. Here N denotes the total number of biangles, n is sequence number of a biangle, R is radius of the trap cylinder, $z_0$ is the trap half-length in the direction of cylinder axis, β is the ratio of total width of all biangles to the circumference length at the trap center.

Since the trap shown in FIG. 1-2 is not open, it must have a larger length-to-diameter ratio in order for excitation was uniform (independent of the axial coordinate) in a large volume. Despite said elongation, the electric field inside the trap (averaged over the cyclotron frequency) will remain hyperboloidal unlike a conventional cylindrical trap. Performance of the trap shown in FIG. 1-2 was analyzed using the ion motion simulating software developed by authors. Results of said simulation had shown that the ion misphasing rate in a dynamically harmonized closed ICR trap is more than 3.5 times lower than in the trap with compensation electrodes (described in the article A. V. Tolmachev, et al., J. Am. Soc. Mass Spectrom., 2008, 19, 586), which results in the same difference in resolution.

Figure 3:
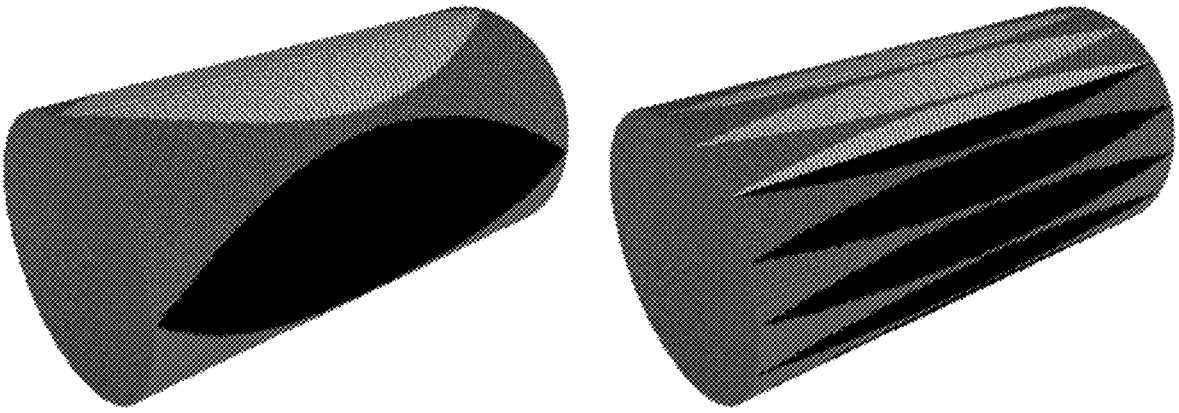
FIG. 3. Examples of dynamically harmonized closed ICR traps with various numbers of segments per trap.

It should be noted that the number of segments in the trap shown in FIGS. 1 and 2 can be different from 2 to any technologically reasonable limit. Larger number of electrodes improves averaging of electric field, which can be important for ions with larger mass. The value N=8 in presented embodiment was chosen for reasons of manufacturing friendly design. FIG. 3 shows examples of traps with different N.

Further increase in resolution of FT/ICR mass spectrometers is possible by way of enhancing magnetic field of solenoids, the resolution theoretically being proportional to the magnetic field magnitude. However, it was found that an increase in magnetic field of solenoid in a Bruker's solarix XR mass spectrometer with the ParaCell dynamically harmonized closed ICR trap up to 12 T or even 15 T had not lead to a proportional increase in resolution (the experiment was carried out by Bruker). Experiments carried out using magnets with field magnitude up to 21 T in the National Laboratory of High Magnetic Fields (USA) also had shown absence of a linear field dependence of resolution. This observation can be explained by the lack of proper vacuum in the trap, which must be the deeper, the higher is the magnetic field. The Bruker's solarix XR instruments suffer from the drawback of necessity in a very long evacuation by vacuum system after trap introduction into the vacuum tube. However, closed-type traps contain many closed volumes (large surface area) and have a problem of vacuum feedthrough. Thus, the existing trap design needs in improvement for further increase in resolution.

The higher is the magnetic field, the longer is ion trajectory within the trap during a certain time of signal recording (due to larger number of complete circles per this time). To increase resolution due to increasing the cyclotron frequency, number of collisions during said time must remain the same, while the vacuum must be deeper. It was found that the resolution of instruments with the field of 7 T increases with time, if the instrument was exploited over a long period (weeks/months) without opening its vacuum system. The existing version of the ParaCell dynamically harmonized closed ICR trap, although ensuring a very high resolution, is limited by necessity in intensive evacuation to create an ultrahigh vacuum in the closed trap space with many closed volumes and large surface area. In addition, the vacuum created by long evacuation will be broken in the course of any technical works associated with trap removal from the instrument (for example, for troubleshooting).

One of solutions capable to increase resolving power of a mass spectrometer at magnetic fields as high as 7 T or more (12 T, 15 T, 21 T, or 24 T) is the use of an open dynamically harmonized ICR trap. Such trap is a cylindrical trap with a complicated geometry of electrodes located on the surface of a single conducting cylinder with the end confining electrodes in the form of open cylinders. Such open trap can be integrated directly into the vacuum system of the mass spectrometer, more precisely, it can be part of a tube inserted into the magnetic field (in contrast to the ParaCell plug-in trap, which is inserted as a complete component into a tube that is part of a vacuum system), which will improve performance of the instrument, increase pumping rate (accelerate evacuation), eliminate necessity in vacuum feedthrough (potentials will be applied to and removed out of electrodes from outside rather than in vacuum), and lead to increase in the maximum resolution limit at a fixed magnetic field.

In such trap, an electrode system is used with cuts (slots) determined by the following equation:

$$\alpha = \frac{2\pi}{N}\left(n + \frac{1}{2}\right) \pm \alpha_0\left(1 - \left(\frac{z}{a}\right)^2\right) \quad (14)$$

and having a parabolic shape. Overlapping regions appear at $|z|<a$ and structurally coincide with electrodes obtained in equation (10). The overlapping regions that constitute the second electrode system are grounded. A potential $V_0$ is applied to the regions formed by parabolic slots with exception of the overlapping regions, whereas the potential 2.2 $V_0$ is applied to the regions extending beyond the slot system and forming the side electrodes.

Figure 4:
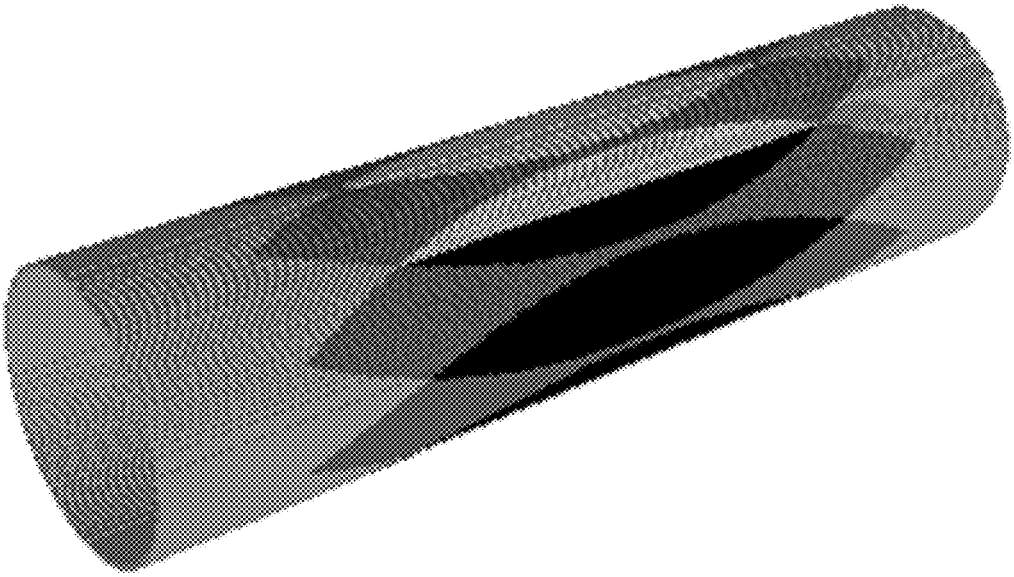
FIG. 4. Dynamically harmonized open ICR trap.
Figure 5:
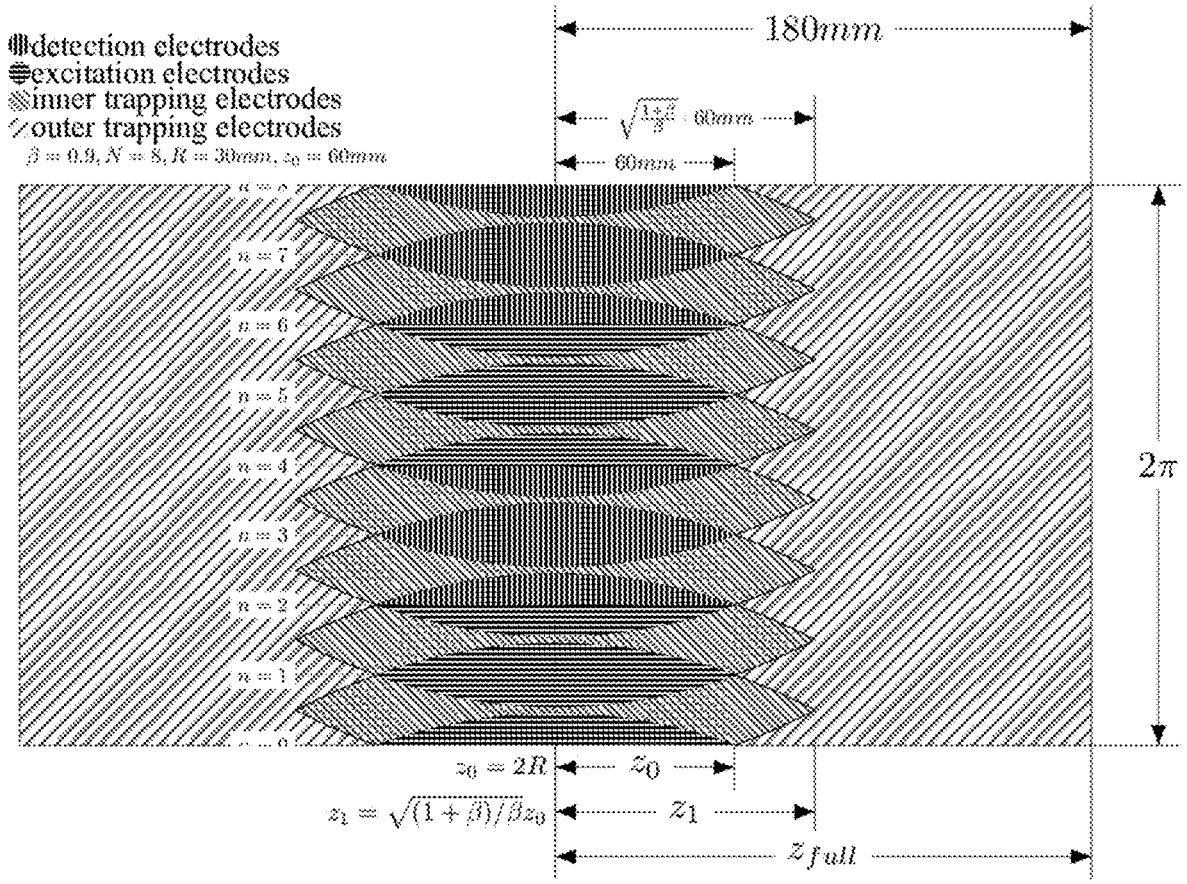
FIG. 5. A detailed segmentation diagram of an embodiment of a dynamically harmonized open ICR trap presented as a projection of electrodes onto a plane by unrolling the cylindrical surface bearing the trap electrode system. In addition to conventions used for FIG. 2, here $z_1$ denotes the half-length of the first biangle system in the direction of trap axis, $z_{full}$ denotes the total half-length of the open trap in the direction of trap axis.

FIGS. 4 and 5 present layout of electrodes of trap according to present invention. To calculate geometry of the open dynamically harmonized ICR trap, the authors had performed a computer simulation of the electric field distribution in such trap. The above described dynamically harmonized closed ICR trap (shown in FIGS. 1 and 2) has blocking electrodes with potential $V_0$ (blocking voltage $V_0$ is also applied to narrower, concave electrodes). The averaged (along the cyclotron trajectory) potential of such trap as a function of z completely coincides with the theoretical one (here and below, trap parameters were adopted as follows: R=30 mm, $z_0$=60 mm, number of segments per trap=8). As exemplary embodiments, electrodes of the closed trap are shown in FIG. 2 in expanded form as lying on the surface of the expanded cylinder for the case of the trap closed from the ends by trap electrodes (end electrodes are not shown).

The idea of open dynamically harmonized ICR trap shown in FIG. 4 is to preserve trap regions with a quadratic dependence of the potential on z when replacing the hemispherical solid end electrodes with open cylindrical ones. In an open trap, ion-blocking electrodes have form of cylindrical electrodes isolated from internal electrode system by a zigzag gap and from external structural parts of the cylindrical trap holder with an annular slot. FIG. 5 shows an embodiment of dynamically harmonized cylindrical trap open on both ends in expanded form in detail and with dimensions. Electrodes used to confine ions within the trap, excite their cyclotron motion, or detect the induced signal are marked by different hatching. Namely, areas with horizontal or vertical hatching have zero potential, with thin back hatching—potential $V_0$, and with thick direct hatching—potential 2.2 $V_0$.

Figure 6:
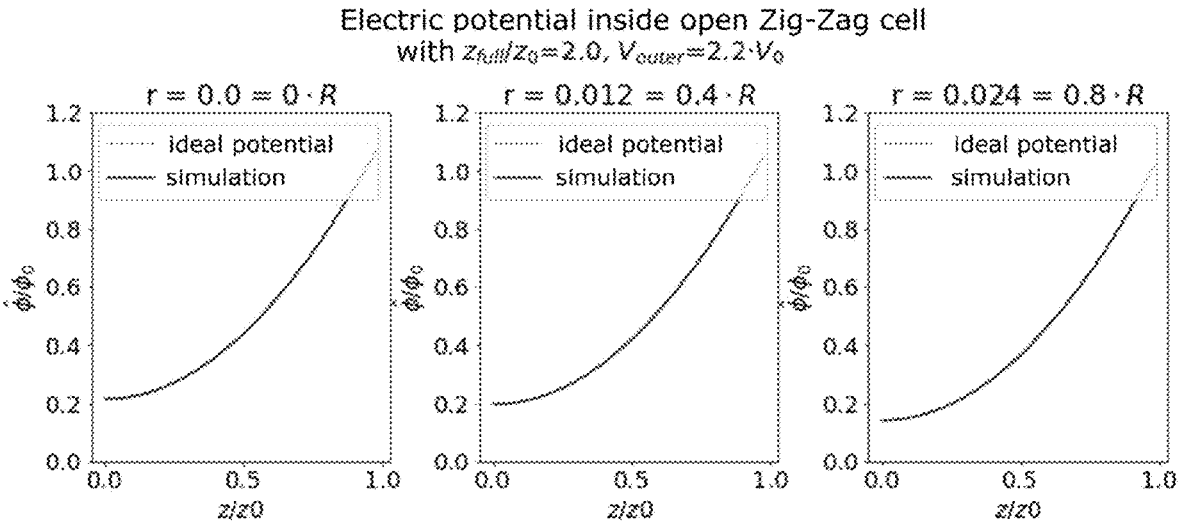
FIG. 6. Dependence of the potential averaged over the cyclotron motion inside a dynamically harmonized open ICR trap on the axial coordinate at different distances from the axis.
Figure 7:
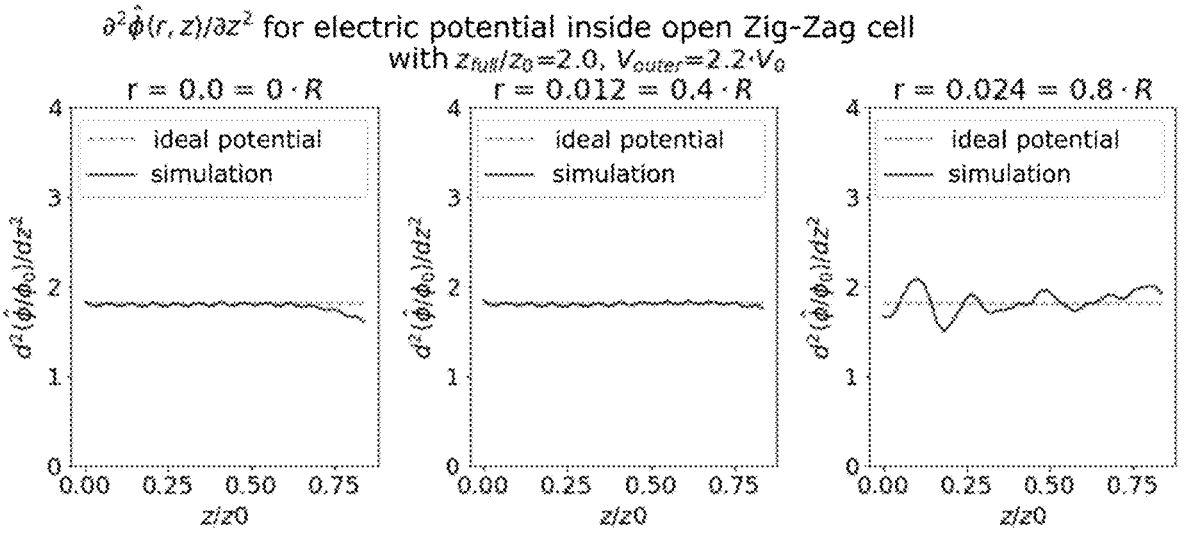
FIG. 7. Dependence of second derivative of the potential averaged over the cyclotron motion inside a dynamically harmonized open ICR trap on the axial coordinate at different distances from the axis.

To simulate operation of the open ICR trap, the trap geometry shown in FIG. 4 with the dimensions shown in FIG. 5 was chosen. The electric field in these studies was calculated using the commercial software SIMION 8.0. FIG. 6 presents results of simulation of the field distribution along the trap axis at different distances from the axis in comparison with the theoretically calculated values. In addition, FIG. 7 presents values of the second derivative of the potential with respect to z at different distances from the trap axis. It can be seen from above results that the open cylindrical trap of the described design is harmonized throughout the entire volume.

Functioning of the trap according to present invention does not differ from functioning of traps used in practice, in particular, installed in modern Fourier transform ion cyclotron resonance spectrometers [E. N. Nikolaev, Y. I. Kostyukevich, G. N. Vladimirov. Fourier transform ion cyclotron resonance (FT ICR) mass spectrometry: Theory and simulations. Mass Spectrom. Rev. 2016. 35: 219-258]. Ions with different mass-to-charge ratios from an ion source fall into an intermediate ion trap, where they are accumulated to an amount sufficient for detection. From the intermediate storage trap, ions of all masses are ejected in the form of a compact cloud into the measuring trap. At the same time, blocking potential of the side electrode located on the ion entrance end decreases, allowing ions to enter the trap. Then the potential increases, and ions become trapped. After an adjustable time delay, a radio-frequency voltage of adjustable duration is applied to the trap electrode group that excites cyclotron motion of ions. The signal induced by rotating ions on the other (detecting) group of electrodes is detected. This signal is recorded and then subjected to the Fourier transform, which yields its frequency spectrum able to be converted into the mass spectrum by a simple algebraic transformation. The ion trap (also known as ion cyclotron resonance measuring cell) is located in the vacuum chamber evacuated to an ultra-deep vacuum ($10^{-10}$ Torr). The chamber is a metal cylinder made of non-magnetic material. It is inserted inside the superconducting solenoid so that the trap was in the region of magnetic field with maximum uniformity.

Despite the fact that the invention is described with reference to the disclosed embodiments it should be obvious to those skilled in the art that the particular specified experiment are given only for illustration purposes and they should not be considered as limiting the scope of the invention in any way. Those skilled in the art would appreciate that it is possible to implement different modifications without departing from the spirit and scope of the present invention.

The invention claimed is:

1. An ion trap of an ion cyclotron resonance (ICR) mass analyzer used for accumulating and detecting ions, having form of an open cylinder without end walls, a conducting surface of the open cylinder being divided by slots into two central electrode systems and two side electrodes, wherein the trap has a plane of symmetry perpendicular to an axis of the open cylinder and passing through a center of the trap;

the first central electrode system consists of an even number of curvilinear overlapping biangles with excluded overlapping regions, wherein only adjacent biangles of this system are overlapped, whereas the second central electrode system consists of the overlapping regions;

width of each biangle of both central systems is a quadratic function of a coordinate directed along the axis of the open cylinder to the center of the trap, and originated from vertexes of the biangle, with maximum electrode width corresponding to the center of the trap;

a constant potential $V_0$ is applied to the first central electrode system through resistors, whereas the second central electrode system is grounded in relation to direct current (DC);

side electrodes of the trap are located on both sides of the first central electrode system, said side electrodes having form of insulated cylinders being a part of the open cylinder having a zigzag joint boundary with the first central electrode system formed by slots in the open cylinder, wherein outer side boundaries of the side electrodes are circles, which electrically isolate the side electrodes from a vacuum system, and a potential 2.2 $V_0$ is applied to the side electrodes;

a field potential inside the trap generated by the two electrode systems is harmonic over an entire trap volume and quadratic along the axis of the open cylinder when averaged over a cyclotron orbit of ions.

2. The ion trap according to claim 1, wherein a) the trap is integrated into a vacuum chamber of the ICR mass analyzer such that inner surfaces of the trap are in vacuum, while the outer surfaces are at atmospheric pressure;

b) the trap is a part of a tube inserted into solenoid generating a magnetic field, c) all slots between the electrodes of the trap are filled with a vacuum-tight insulator, and potentials are applied to the electrodes from the outer surfaces.

3. The ion trap according to claim 1, wherein radio frequency potentials are applied to some of the electrodes of both first and second central electrode systems via capacitors to excite cyclotron motions of ions in the trap, while signals induced by rotating ions are taken from the other electrodes of the second central electrode system.

4. The ion trap according to claim 1, wherein the second central electrode system comprises four, eight, twelve, or sixteen electrodes having shape of a curvilinear biangle located on the surface of the open cylinder.

* * * * *